United States Patent [19]

Lintott

[11] 4,092,965

[45] June 6, 1978

[54] PUMP CONTROL DEVICES

[75] Inventor: Edward Robert Lintott, London, England

[73] Assignee: Lucas Industries Limited, Birmingham, England

[21] Appl. No.: 722,432

[22] Filed: Sep. 13, 1976

[30] Foreign Application Priority Data

Sep. 27, 1975 United Kingdom ..... 39666/75

[51] Int. Cl.[2] ..... F02D 1/04; F02D 1/06

[52] U.S. Cl. ..... 123/140 FG; 123/196 S; 123/198 DB

[58] Field of Search ..... 123/196 S, 198 D, 198 DB, 123/198 DC, 140 FG

[56] References Cited

U.S. PATENT DOCUMENTS

| | | | |
|---|---|---|---|
| 1,856,584 | 5/1932 | Parkhill | 123/196 S |
| 2,225,234 | 12/1940 | Schettler | 123/196 S |
| 3,153,403 | 10/1964 | Dobbs | 123/198 DB |
| 3,853,110 | 12/1974 | Merwe | 123/198 DB |
| 3,977,384 | 8/1976 | Jaan | 123/198 DB |

*Primary Examiner*—Ronald B. Cox

[57] ABSTRACT

A control device for the fuel pump of an internal combustion engine includes a piston which can be subjected to a fluid pressure to move a control member of the fuel pump to a position in which no fuel is supplied to the engine. Fluid under pressure is admitted to the cylinder containing the piston through an inlet and a solenoid operable valve is provided for controlling the admission of fluid to the cylinder. The valve is under the control of a switch arranged so that when the switch is opened fluid under pressure is applied to the piston.

12 Claims, 10 Drawing Figures

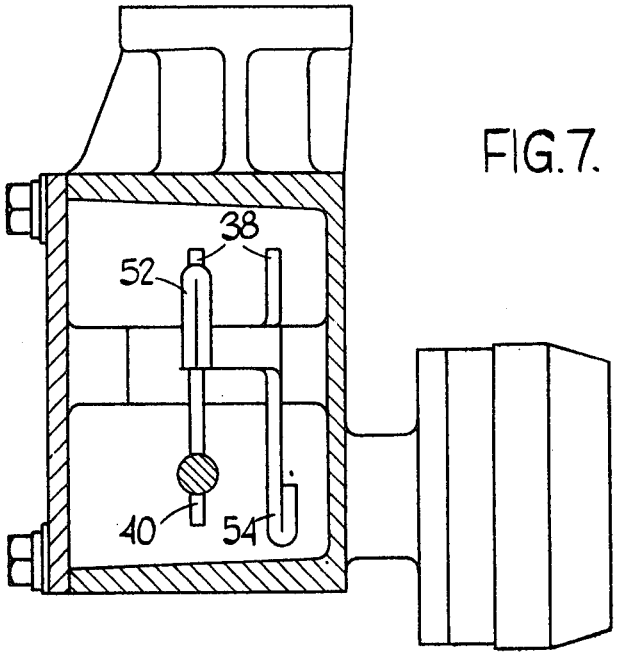
FIG.7.
FIG.8.
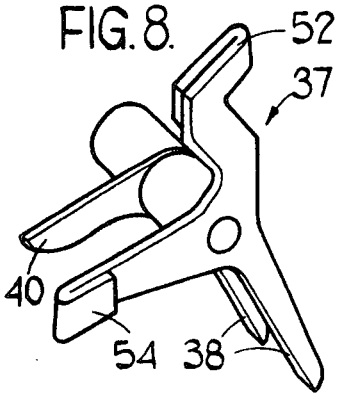
FIG.9.
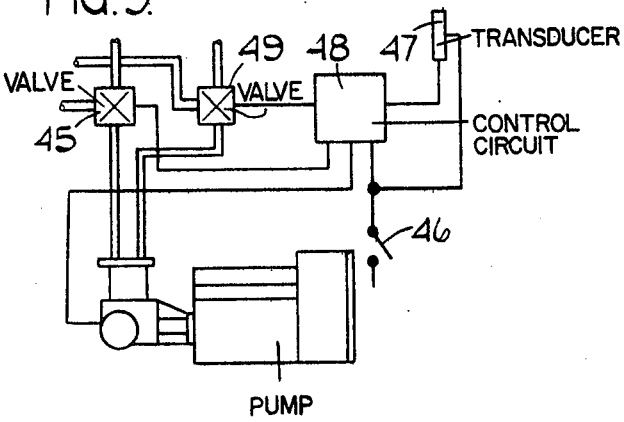
FIG.10.
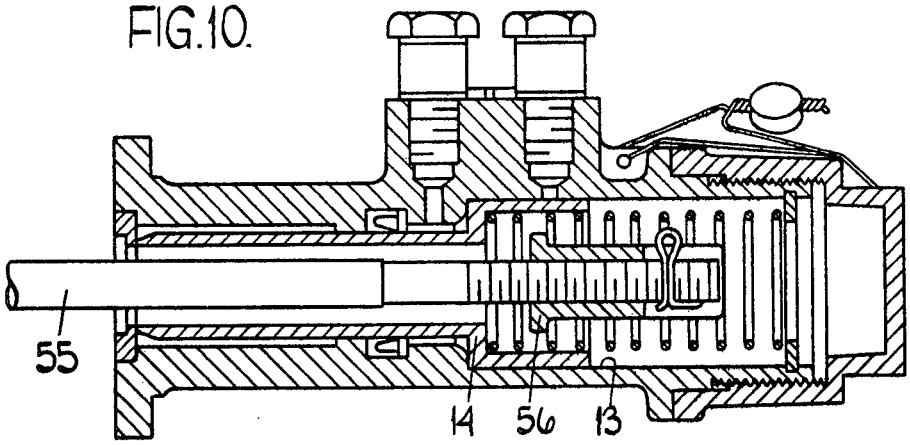

PUMP CONTROL DEVICES

This invention relates to a control device for the fuel pump of an internal combustion engine the pump being of the kind including a control member movable to influence the supply of fuel to the engine.

An object of the invention is to provide a control device in a form in which operation of an electrical switch can effect stopping of the engine.

According to the invention a control device for a fuel pump of the kind specified includes a fluid pressure operable piston arranged when fluid under pressure is applied thereto, to move said control member to a position in which no fuel is supplied to the engine and a solenoid operable valve controlled by a manually operable switch, said valve when said switch is opened, serving to allow fluid under pressure to be applied to said piston.

According to a further feature of the invention said fluid under pressure is obtained from the pressure lubrication system of the engine.

According to a further feature of the invention a solenoid operable latch is provided to retain said member in said position, said latch being disengaged when said switch is closed.

Figure 1:
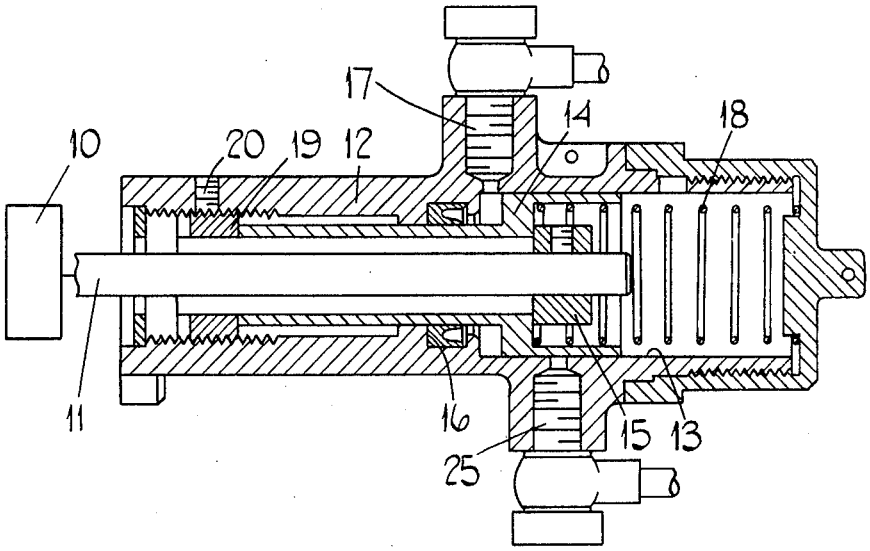
Figure 2:
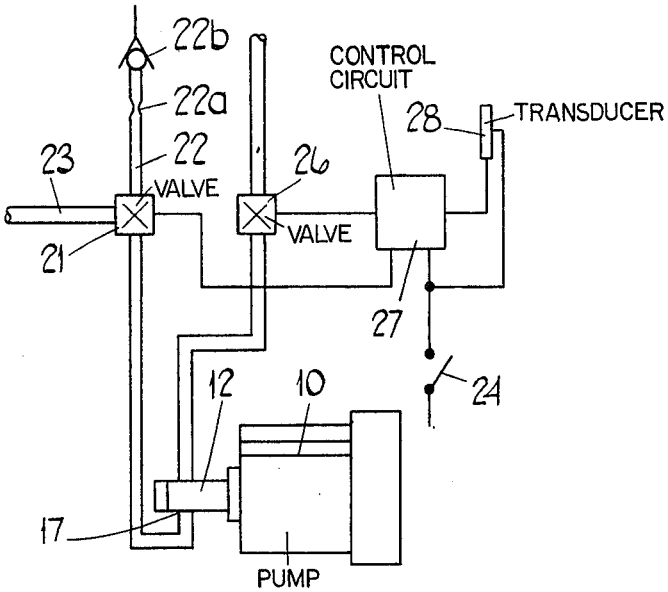
Figure 3:
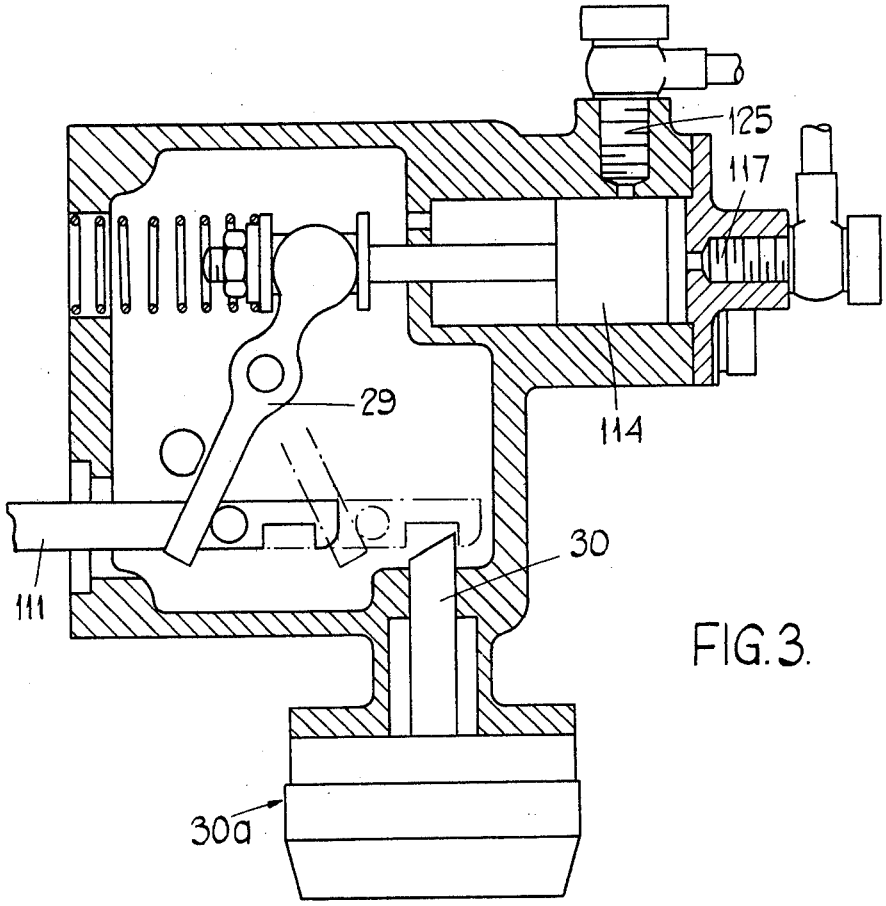
Figure 4:
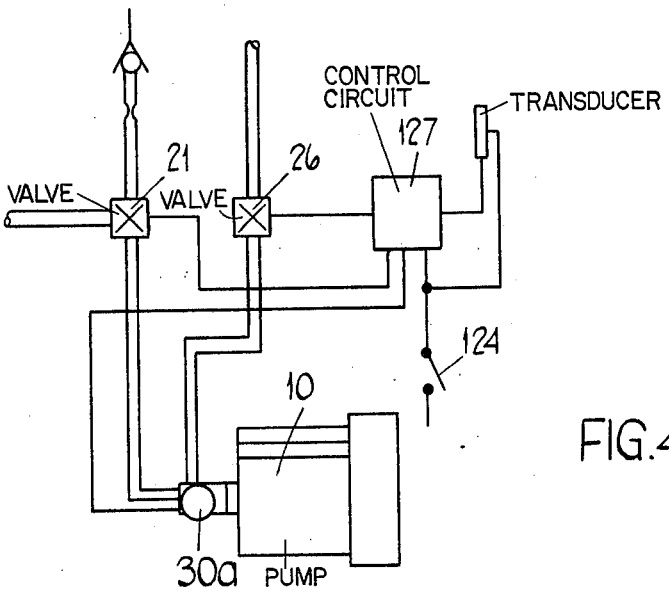
Figure 5:
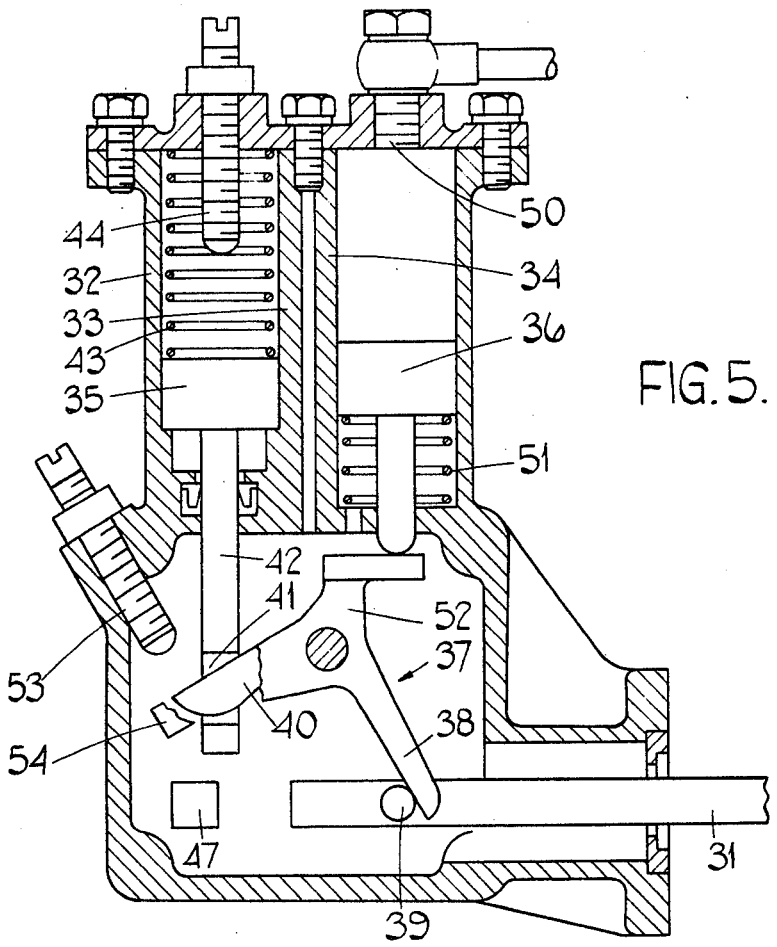
Figure 6:
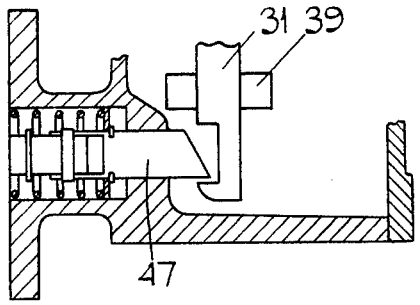

Examples of pump control devices in accordance with the invention will now be described with reference to the accompanying drawings in which, FIG. 1 is a sectional side elevation of one example of the device, FIG. 2 is a electro/fluid circuit diagram associated with the device of FIG. 1, FIG. 3 shows the layout of a further device, FIG. 4 is a circuit diagram similar to FIG. 2 but appropriate to the device of FIG. 3, FIG. 5 is a sectional side elevation of a further example of the device, FIG. 6 is a part section on the line A—A of FIG. 5 but rotated through 90°, FIG. 7 is a sectional plan view of the device of FIG. 5, FIG. 8 is a perspective view of a portion of the device seen in FIG. 5, FIG. 9 is a diagram similar to FIG. 2 but appropriate to the device shown in FIGS. 5 - 8 and FIG. 10 is a sectional side elevation of another example of the device shown in FIG. 1.

With reference to FIGS. 1 and 2 of the drawings, there is shown a fuel pump 10 which is driven in timed relationship with an associated engine and which supplies fuel to the cylinders of the engine at the appropriate times. The pump includes a control member in the form of the rod 11 seen in FIG. 1, the rod 11 being axially movable. Conveniently the rod is the control rod of the pump so that the axial position of the rod determines the amount of fuel which is supplied to the engine. Alternatively however the rod could be a control member specifically provided for the purpose of stopping the flow of fuel to the engine. In the position shown in FIG. 1 the rod 11 is in a position in which the maximum amount of fuel is supplied to the engine and is movable towards the right to reduce the amount of fuel supplied.

Secured to the pump 10 is a housing 12 in which is defined a stepped cylindrical bore 13. The bore 13 carries a stepped piston 14 which is formed with a stepped recess complementary to the periphery of the piston and through which the rod 11 extends. Moreover, the rod 11 is provided at its end remote from the pump 10, with an abutment 15 engageable with the step defined between the wider and narrower portions of the recess.

A fluid seal 16 is provided about the narrower portion of the piston and the space defined between the end of the bore and the wider portion of the piston is in communication with an inlet 17 for fluid under pressure. The piston is loaded by means of a coiled compression spring 18 and the extent of movement under the action of the spring 18 is determined by a stop 19 which is in screw thread engagement with the housing and which can be locked by means of a set screw 20. The arrangement is such that if fluid under pressure is supplied through the inlet 17, the piston 14 moves against the action of its spring and by way of the abutment 15, moves the rod 11 to a position in which no fuel is supplied to the engine.

Referring now to FIG. 2 the inlet 17 is connected to one outlet of a solenoid valve 21 having an inlet connected to a conduit 22 which communicates with the pressure lubrication system of the associated engine by way of a restrictor **22*a* and a non-return valve 22*b*. The valve 21 also includes a further outlet which can be connected by a conduit 23 to allow lubricating oil to return to the engine. The solenoid associated with the valve, is energized when a manually operable switch 24 is closed and in this position the supply of oil from the lubrication system of the engine is prevented from reaching the inlet 17. However, the inlet 17 is placed in communication with the conduit 23. When the switch 24 is opened then the solenoid valve reverts to its alternative position in which lubricating oil flows to the cylinder 13 and acts upon the piston 14 in the manner described. Therefore when the switch 24 is opened the piston 14 moves the rod 11 to the position in which the supply of fuel to the engine is halted. The engine therefore will stop and as the pressure in the lubrication system of the engine gradually falls the pressure is trapped in the cylinder by the valve 22*b*. When it is required to start the engine then the switch 24 must be closed and the piston 14 will move to the position in which it is shown thereby allowing fuel to be supplied to the engine, the oil being displaced from the cylinder by the action of the spring 18 and returning through the conduit 23**.

Also shown in FIG. 1 is an additional port 25 which opens into the cylinder 13 at a point removed from the closed end thereof. As shown in FIG. 1, the port 25 is covered by the piston. The inlet 25 communicates by way of a solenoid valve 26, with a low pressure part of the engine lubrication system and the supply of electric current to the solenoid valve 26 is under the control of a control circuit 27. The control circuit 27 is also supplied with a signal by means of a temperature sensitive transducer 28.

When the engine is in operation, the valve 21 and also the valve 26 will be closed. However, in the event that a predetermined temperature of the engine is exceeded, the circuit 27 passes a signal to the solenoid valves 21 and 26 and lubricating oil under pressure is supplied to the cylinder 13. This moves the piston 14 against the action of its spring 18 thereby tending to reduce the maximum amount of fuel which can be supplied to the engine. An equilibrium position is established when the piston 14 uncovers the port 25. When this occurs the lubricating oil flows by way of the solenoid valve 26 to the low pressure portion of the lubrication system and the piston 14 assumes an equilibrium position. Thus the maximum amount of fuel which can be supplied to the engine is temporarily reduced and when the temperature of the engine falls the solenoid valves 21 and 26 revert to their original state and the piston 14 is returned by the action of the spring 18. The oil which is displaced from the cylinder 13 by this movement flows by way of the valve 21 back to the engine lubrication system.

If it is required to stop the engine whilst the piston 14 is in the aforesaid equilibrium position, then opening of the switch 24 will effect closure of the solenoid valve 26 and the piston 14 will move its maximum extent to cut off the supply of fuel to the engine.

Referring now to FIGS. 3 and 4. The device shown therein has a different mechanical layout in that the piston 114 is coupled to the control rod 111 by means of a rocking lever 29. The inlets 117 and 125 correspond with the inlets 17 and 25 and the fluid connections to these inlets are the same as in the example of FIG. 1. The example of FIG. 3 however incorporates a latch 30 which is engageable within a recess defined in the control member 111 to positively retain the control member in the position in which no fuel is supplied to the engine. The latch 30 is operated by means of a solenoid 30*a* which is de-energised when the switch 124 is opened. In the de-energised position the latch is engageable with the control member 111 to retain same in the position in which no fuel is supplied to the engine. It will be noted from FIG. 3 that the end of the latch is inclined so as to permit easy displacement of the latch against the action of the loading spring, when the control member 111 is moved to the position of no fuel supply to the engine by means of the piston 114. The solenoid operable latch as seen in FIG. 4, is connected to the control circuit 127 but it plays no part in the control of the amount of fuel supplied to the engine when the engine temperature exceeds the aforesaid predetermined value.

Turning now to the device shown in FIGS. 5, 6, 7, 8 and 9 of the drawings, fresh reference numerals have been utilized. The control member of the pump is shown at 31 and in the position shown the control member is set to supply the maximum amount of fuel to the engine. The device includes a housing 32 which defines a pair of cylinders 33, 34 in which are located respective pistons 35, 36. Also provided is a hinged link assembly generally indicated at 37 and shown in perspective in FIG. 8. The link assembly has a pair of arms 38 engageable with a pin 39 extending on opposite sides of the control member 31. In addition, the link assembly has a further arm 40 which passes through an aperture 41 located in a rod 42 secured to the piston 35 and is connected to one of the arms 38. This piston is loaded in a downwards direction by means of a spring 43 and the extent of its upward movement is determined by an adjustable stop 44. The underside of the piston 35 can be subjected to the lubricating oil pressure of the engine by way of a solenoid valve 45 which is identical with the solenoid valve 21 of the earlier examples. When fluid under pressure is supplied by way of the solenoid valve 45 as when the switch 46 is opened, the piston 35 is moved upwardly against the action of the spring 43 and the control member 31 is moved to the position in which no fuel is supplied to the engine. In addition, as with the example shown in FIG. 3, a solenoid operable latch member 47 is provided and when the switch 46 is opened the latch member 47 moves to a position to retain the control member 31 in the position in which no fuel is supplied to the engine. When the switch 46 is closed as when it is required to start the engine, the latch 47 is withdrawn. Moreover, the communication of the cylinder 33 with the engine lubrication system is cut off by means of the valve 45.

The additional piston 36 is provided for the purpose of reducing the maximum amount of fuel which can be supplied to the engine in the event that the temperature of the engine exceeds a predetermined value. The engine temperature is sensed by the transducer 47 which passes a signal to the control circuit 48. When such a signal is given, the control circuit supplies a signal to a further solenoid operable valve 49 which opens to supply lubricating oil under pressure to the cylinder 34 by way of an inlet 50. The piston 36 is therefore moved against the action of a spring 51 and its piston rod bears against a further arm 52 of the link assembly 37. The arm 52 is moved angularly in the clockwise direction as seen in FIG. 5, and is connected to the other of the arms 38 so as to move the control member 31 to a position so that the maximum amount of fuel which can be supplied to the engine is reduced. The amount of reduction is determined by a stop 53 which is engaged by a further arm 54 connected to the arm 52. When the engine temperature falls then the valve 49 is de-energised and the piston 36 returns under the action of its spring to permit the full quantity of fuel to be supplied to the engine, the oil displaced from the cylinder 34 being returned to the engine lubrication system.

The device shown in FIG. 10 is very similar to that which is shown in FIG. 1 the only significant difference being the adjustment. In the arrangement of FIG. 1 the control rod 11 is shown to be in a maximum fuel position with the abutment 15 engaging the piston and the piston engaging the stop 19. It will be appreciated that the control rod can move towards the right as seen in FIG. 1 independently of the piston 14 such movement being under the action of a governor forming part of the pump.

In the device shown in FIG. 10 the adjustable stop 19 is omitted and the extent of movement of the piston 14 under the action of its spring, is limited by its abutment with the end of the cylinder 13. The control rod 55 at its end within the cylinder is provided with a screw thread and mounted on the control rod is an adjustable abutment 56 of sleeve like form and having a head engageable by the piston. A split pin extends through a transverse bore in the rod and is located within slots formed in the sleeve, the split pin being inserted when the abutment has been correctly positioned in the rod. The control rod is again shown in the maximum fuel position, this position being determined by a stop within the fuel pump. The operation of the device is as described with reference to FIG. 1.

As described the transducers 28, 47 are responsive to engine temperature whereby when the engine temperature is exceeded there is brought about a reduction in the maximum amount of fuel which can be supplied to the engine. The transducer or further transducers may be responsive to other engine operating conditions which when they occur, require the maximum amount of fuel to be reduced. For example the or a further transducer may be responsive to the air pressure within the inlet manifold of the associated engine, the fuel level being reduced as the air pressure falls to a predetermined value. In the case of an engine of a vehicle fitted with an automatic transmission system the transducer can sense when a change of gear ratio is about to be made and in the case of a ratio change which will result in reduced engine speed, the transducer operates to effect a reduction in the fuel supply to the engine.

I claim:

1. A control device for the fuel pump of an internal combustion engine, the pump being of the kind including a control member movable to influence the supply of fuel to the engine, the device including a fluid pressure operable piston arranged when fluid under pressure is applied thereto, to move said control member to a position in which no fuel is supplied to the engine and a solenoid operable valve controlled by a manually operable switch, said valve when said switch is opened, serving to allow fluid under pressure to be applied to said piston, a cylinder in which said piston is located, an inlet for fluid under pressure in said cylinder, said inlet being controlled by said solenoid operable valve, a port formed in the wall of the cylinder said port being uncovered by said piston when the latter has moved a predetermined extent under the action of fluid under pressure supplied through said inlet, and a further solenoid operable valve for controlling flow through said port, the arrangement being such that when said further solenoid operable valve is closed the piston can move its maximum extent in the cylinder under the action of fluid pressure but when said further solenoid operable valve is open the piston will move only so far as to uncover said port.

2. A device according to claim 1, in which said piston is provided with a piston rod extending from the cylinder, and a pivotal link one arm of which is engaged by said piston rod, the other arm of said link being engageable with an abutment on the control member.

3. A device according to claim 1 in which said piston is of hollow form and is provided with a wider portion and a narrower portion, a stepped bore defined in a body part and accommodating said piston, means defining a fluid seal between the narrower portion of the piston and the wall of the narrower portion of the bore, said inlet being positioned so that fluid under pressure can act against the step defined between the narrower and wider portion of the piston, said port opening into the wider portion of the bore so as to be uncovered by the step on the piston, a stepped recess within the piston, said control member extending through the narrower portion of the recess into the wider portion of the recess and an abutment carried by the control member said abutment being engageable by the step defined between the narrower and wider portions of the recess when fluid under pressure is admitted through said inlet.

4. A device according to claim 3 including resilient means biasing the piston against the action of the fluid under pressure.

5. A device according to claim 4 in which said resilient means comprises a coiled compression spring interposed between an end closure for the wider end of the bore and the step defined in said recess.

6. A device according to claim 5 in which the means defining a fluid seal comprises a seal element located within a groove defined in the wall of the narrower portion of the bore.

7. A device according to claim 6 including an abutment acting to limit the movement of the piston under the action of said coiled compression spring.

8. A device according to claim 7 in which said abutment is defined by the steps on the periphery of the piston and the step in the wall of the bore.

9. A device according to claim 7 in which said abutment is an annular member adjustably mounted in the wall of the narrower portion of the bore.

10. A device according to claim 8 in which the abutment carried by the control member is adjustable thereon.

11. A device according to claim 1 in which said first mentioned solenoid operable valve has an inlet for communication with a source of fluid under pressure, an outlet through which fluid can escape from the cylinder, and a further port connected to said inlet of the cylinder, said valve when energised placing said further port in communication with said outlet.

12. A device according to claim 11 in which the inlet of said valve is in use, connected to the lubrication system of the associated engine by way of a restrictor and a non-return valve connected in series.

* * * * *